US005184725A

United States Patent [19]

Reinheimer et al.

[11] Patent Number: 5,184,725

[45] Date of Patent: Feb. 9, 1993

[54] RECLOSABLE PACKAGE FOR CELLULOSE TISSUES

[75] Inventors: Horst Reinheimer, Heroldsberg; Christof Stary, Eckental, both of Fed. Rep. of Germany

[73] Assignee: VP-Schickedanz AG, Nuremberg, Fed. Rep. of Germany

[21] Appl. No.: 854,692

[22] Filed: Mar. 20, 1992

[30] Foreign Application Priority Data

Mar. 25, 1991 [DE] Fed. Rep. of Germany ... 9103648[U]
Aug. 8, 1991 [DE] Fed. Rep. of Germany ... 9109814[U]

[51] Int. Cl.[5] ..... B65D 73/00

[52] U.S. Cl. ..... 206/494; 206/260; 206/273; 383/84; 383/120

[58] Field of Search ..... 206/260, 271, 273, 494; 383/84, 98, 99, 120, 903

[56] References Cited

U.S. PATENT DOCUMENTS

| | | | |
|---|---|---|---|
| 475,676 | 5/1892 | Cussen | 206/260 |
| 1,430,637 | 10/1922 | Gaede | 206/260 |
| 1,575,420 | 3/1926 | Eisenstark et al. | 206/260 |
| 2,000,345 | 5/1935 | Miller | 383/903 |
| 2,506,311 | 5/1950 | Moore | 206/260 |
| 2,779,144 | 1/1957 | Nail | 383/903 |
| 3,828,923 | 8/1974 | Phillips, Jr. | 206/273 |

FOREIGN PATENT DOCUMENTS 7539076 4/1976 Fed. Rep. of Germany .

*Primary Examiner*—David T. Fidei
*Attorney, Agent, or Firm*—Spencer, Frank & Schneider

[57] ABSTRACT

A reclosable package for containing a stack of cellulose tissues includes a block-shaped package which is made from a single sheet of material cut into a one-piece pattern and folded, which block-shaped package includes a front side having an upper end in which is defined a cutout having opposed ends to provide an enlarged removal area through which the cellulose tissues may be removed in use, a rear side having an upper end, right and left sides each having an upper end, a bottom, a top cover extending from the upper end of the rear side and having a pair of sides and an upper end, a closing flap having an upper edge with opposed ends extending from the upper end of the top cover, and left and right lateral closing folds for increasing resistance to tearing extending from the upper ends of respective sides and from the respective sides of the top cover, and each having a free edge, and which block-shaped package has a closed state in which the closing flap and top cover are folded downwardly over the cellulose tissues in use, and the closing flap extends beyond the cutout in the front side, and has an open state in which the closing flap, top cover and lateral closing folds are folded uwpardly to expose the cellulose tissues in use and in which the free edges of each lateral closing fold extends in a straight line from a respective opposed end of the upper edge of the closing flap to an adjacent end of the cutout.

5 Claims, 1 Drawing Sheet

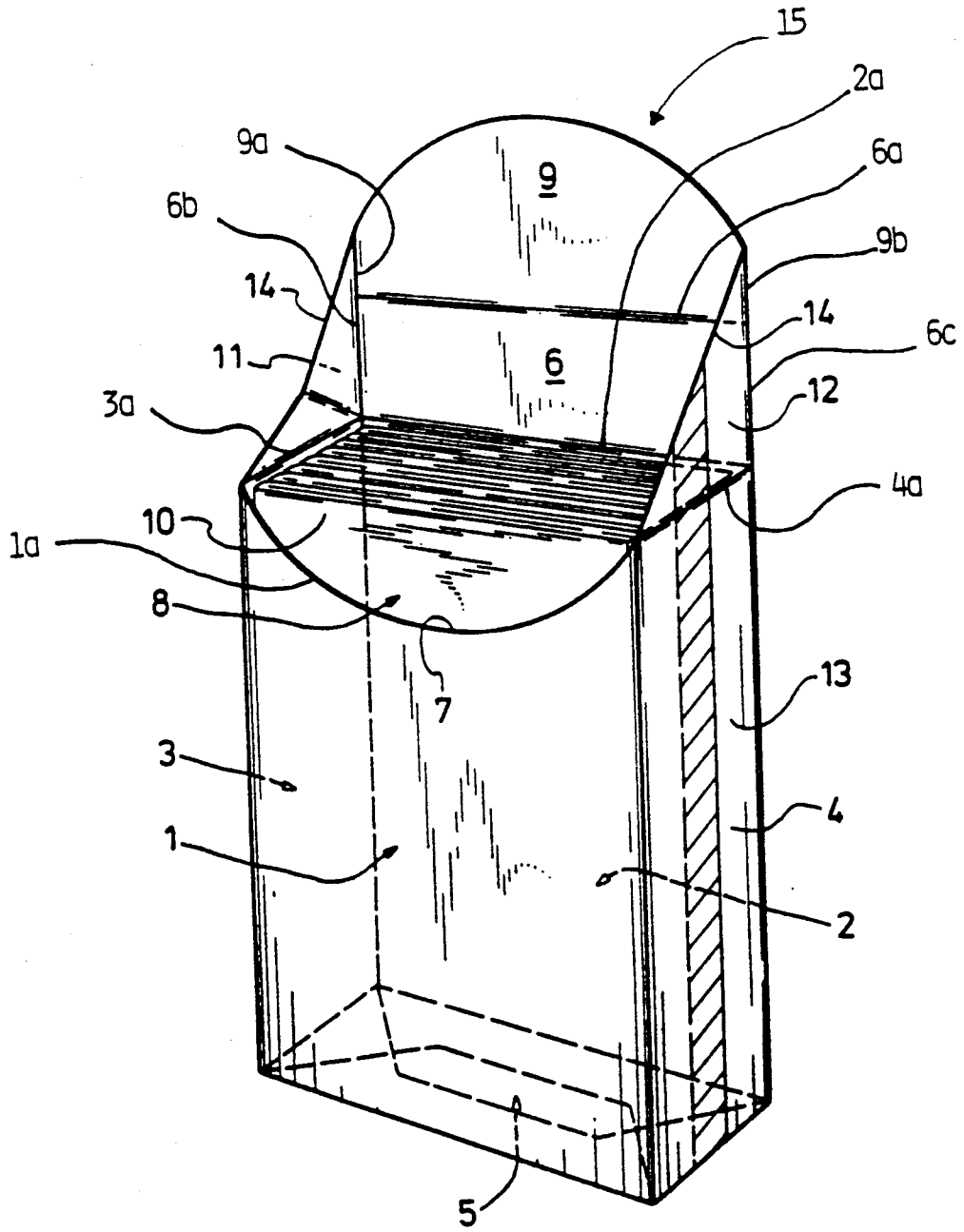
15
2a
9a
6a
9
6b
9b
14
14
6c
11
6
12
3a
4a
10
1a
8
7
13
3
4
1
2
5

RECLOSABLE PACKAGE FOR CELLULOSE TISSUES

BACKGROUND OF THE INVENTION

1. Field of the Invention.

The present invention relates to a reclosable package for pocket packs of cellulose tissues.

2. Background of the Art.

Cellulose tissues, that is, paper handkerchiefs for pocket packs are typically packaged in manageable stacks, usually in packs of ten sheets, and are sold as such as convenience pocket packs. In the past, the packages were made of glassine and later, beginning approximately in the early sixties, of polyethylene sheets. In more recent times, attempts have been made to return to paper packages since biodegradable materials protect the natural environment because the unavoidably discarded packages are then easier to dispose of in an ecologically sound manner.

The basic shape for the production of such packages is primarily the block shape, with the packages presently available on the market usually having an upright or transverse orientation. Other possibly appropriate shapes, such as, for example, a book-like package or also a square package, have not found much acceptance so far.

German Utility Model Patent No. 75 39 076 discloses a reclosable package for a stack of cellulose tissues that can be produced, i.e., cut and folded, from a single pattern piece. The package has the following known features. The block-shaped package has six sides or faces, namely, a major front side, a major rear side, a right side, a left side, a bottom, and an upper cover. A cutout is defined in the upper edge of the major front side in order to enlarge the tissue removal area, while the major rear side is extended in one piece to form a closing flap. The closing flap can be folded over the contents of the package and, when folded downwardly, extends beyond the cutout in the major front side. The two sides also extend beyond the contents of the package and form lateral closing folds connected with the closing flap.

The prior art packages are suitable exclusively for manufacture from polyethylene sheet, however. Such sheets are considerably tear resistant so that no problems arise if the closing flap is to be opened and reclosed several times.

If, however, such packages were made of paper, for example, glassine or soda tissue paper, the danger would exist that the package, particularly if it were opened hastily, would tear in the region of the sides whose lateral closing fold extensions are connected with the closing flap.

SUMMARY OF THE INVENTION

It is an object of the present invention to improve prior art packages by making packages which are more tear resistant, particularly in the above-mentioned critical region, so that the packages can be manufactured of "Folie", i.e., thin sheets of plastic and/or metal foil, but also of paper, without problems.

The present invention solves this problems by providing a package additionally including the feature that the free edge of each lateral closing fold has the form of a smooth curve, i.e., a straight line or a curved line, for example, a circular arc, a parabolic segment or the like. In this context, for the purposes of the present invention, the term "smooth curve" is to be understood to mean that the edge of the cut piece has no sharp bends, corners or the like when extended in one plane, i.e., when flattened out.

The present invention thus provides a reclosable package for containing a stack of cellulose tissues, including a block-shaped package which is made from a single sheet of material cut into a one-piece pattern and folded, which block-shaped package includes a front side having an upper end in which is defined a cutout to provide an enlarged removal area through which the cellulose tissues may be removed in use, a rear side having an upper end, right and left sides each having an upper end, a bottom, a top cover extending from the upper end of the rear side and having a pair of sides and an upper end, a closing flap extending from the upper end of the top cover, and left and right lateral closing folds for increasing resistance to tearing extending from the upper ends of respective sides and from the respective sides of the top cover, and each having a free edge, and which block-shaped package has a closed state in which the closing flap and top cover are folded downwardly over the cellulose tissues in use, and the closing flap extends beyond the cutout in the front side, and has an open state in which the closing flap, top cover and lateral closing folds are folded upwardly to expose the cellulose tissues in use and in which the free edges of the lateral closing folds extend in a smooth curve.

Preferably the material is paper, most preferably soda tissue paper. The block-shaped package is preferably an upright package. Preferably the free edges of the lateral closing folds, in the open state in which they are extended to lie respectively in a single plane, extend in a "smooth curve" which is a straight line or a curved line.

Preferably the closing flap has a pair of sides and the left and right lateral closing folds additionally extend from respective sides of the closing flap.

With the free edges of the lateral closing folds configured as a "smooth curve", it is possible to considerably increase the tear resistance of these critical regions. Measurements made specifically for this purpose have shown that prior art packages made of soda tissue paper have a tear breaking strength of less than 5 N. When comparable packages were produced having free edges configured according to the smooth pattern of the present invention, but otherwise configured completely the same and made of the same soda tissue paper, a tear breaking strength of more than 10 N resulted. The increase in tear breaking strength was thus considerable and was actually not predictable. More significantly, such a tear breaking strength is entirely sufficient to make the package usable even if, as already mentioned, it is manufactured of paper.

BRIEF DESCRIPTION OF THE DRAWING

The sole drawing figure is an exemplary perspective view of one embodiment of a reclosable package according to the present invention.

DESCRIPTION OF THE PREFERRED EMBODIMENTS

The invention will now be described in greater detail with reference to the drawing.

In the illustrated embodiment, reclosable package 15 is shown as a block-shaped package 15 which stands upright. A single sheet of material is cut into a one-piece pattern and folded so that the block-shaped package 15 has a major front side 1, a major rear side 2, a left side 3, a right side 4, a bottom 5, and a top cover 6. The top cover is shown folded upwardly in the drawing since the reclosable package is shown in the open state.

The front side 1 has an upper end 1*a* in which is defined a cutout 7 so as to enlarge removal opening 8 through which contents 10 of the package 15 are withdrawn.

In the opened state, the removal opening 8 thus coincides with and is defined by the space occupied in the closed state by top cover 6, but, because of the provision of the cutout 7, it also partially extends into the front side and is thus further defined by cutout 7.

Rear side 2 includes an upper edge 2*a* from which extends top cover 6. Top cover 6 includes an upper end 6*a*, and a pair of sides 6*b*, 6*c*, namely, left side 6*b* and right side 6*c*. A one-piece extension from the upper end 6*a* of the top cover 6 forms a closing flap 9 which can be folded over contents 10 of the package 15, shown in the figure as a vertical stack of cellulose tissues 10. When folded down, closing flap 9 extends beyond cutout 7 in front side 1. Left and right sides 3 and 4 include respective upper ends 3*a*, 4*a*, and extending from the respective upper ends 3*a*, 4*a* are left and right lateral closing folds 11, 12. Closing folds 11, 12 also extend from the respective sides 6*b*, 6*c* of top cover 6 and extended beyond contents 10 of package 15.

The drawing shows that the entire package 15 is made from a single sheet of material cut into a one-piece pattern and folded. In the illustrated example, the folded package 15 has an overlap zone 13 in the region of the right side 4 and is closed within this zone by gluing, welding, stamping or other suitable means. In other embodiments (not shown), an overlap zone could alternatively be provided in left side 3.

Insofar as the package 15 shown in the drawing figure has been described up to this point, its features are generally known in the art. If such a package were manufactured of paper, for example, glassine or soda tissue paper, the danger would exist that lateral closing folds 11 and 12 would tear if the package were opened hastily. This danger can be overcome if free edge 14 of each lateral closing fold 11, 12 forms a "smooth curve". This "smooth curve" may be a straight line, as shown in the drawing, or a curved line, for example, a circular segment, a parabolic segment or the like. In the drawing, the reason that edge 14 of lateral closing fold 11, appears to have a sharp bend in it is that the figure was drawn as if closing flap 9 has not been pulled completely toward the rear into the fully open state but is inclined forward somewhat in the direction toward the closure, i.e., the cutout 7, on the left side. If top cover 6 and flap 9 were extended completely, free edge 14, of the lateral closing fold 11 would also be a straight line as is free edge 14 of lateral closing fold 12.

It will be understood that the above description of the present invention is susceptible to various modifications, changes and adaptations, and the same are intended to be comprehended within the meaning and range of equivalents of the appended claims.

What is claimed is:

1. A reclosable package for containing a stack of cellulose tissues, comprising:

a block-shaped package which is made from a single sheet of material cut into a one-piece pattern and folded, which block-shaped package includes:

a front side having an upper end in which is defined a cutout having opposed ends to provide an enlarged removal area through which the cellulose tissues may be removed in use, a rear side having an upper end, right and left sides each having an upper end, a bottom, a top cover extending from the upper end of the rear side and having a pair of sides and an upper end, a closing flap having an upper edge with opposed ends extending from the upper end of the top cover, and left and right lateral closing folds for increasing resistance to tearing extending from the upper ends of respective sides and from the respective sides of the top cover, and each having a free edge, wherein the block-shaped package has a closed state in which the closing flap and top cover are folded downwardly over the cellulose tissues in use, and the closing flap extends beyond the cutout in the front side, and wherein the block-shaped package has an open state in which the closing flap, top cover and lateral closing folds are folded upwardly to expose the cellulose tissues in use and in which the free edge of each lateral closing fold extends in a straight line from a respective opposed end of the upper edge of the closing flap to an adjacent end of the cutout.

2. The reclosable package according to claim 1, wherein the material is paper.

3. The reclosable package according to claim 2, wherein the paper is soda tissue paper.

4. The reclosable package according to claim 1, wherein the block-shaped package is an upright package.

5. The reclosable package according to claim 1, wherein the closing flap has a pair of sides, and wherein the left and right lateral closing folds additionally extend from respective sides of the closing flap.

* * * * *